US008827386B1

(12) United States Patent
Kennard

(10) Patent No.: US 8,827,386 B1
(45) Date of Patent: Sep. 9, 2014

(54) TABLE ASSEMBLY

(71) Applicant: Lawrence Kennard, New Orleans, LA (US)

(72) Inventor: Lawrence Kennard, New Orleans, LA (US)

( * ) Notice: Subject to any disclaimer, the term of this patent is extended or adjusted under 35 U.S.C. 154(b) by 0 days.

(21) Appl. No.: 13/774,396

(22) Filed: Feb. 22, 2013

(51) Int. Cl.
*A47B 83/00* (2006.01)
*A47B 3/08* (2006.01)
*A47B 37/00* (2006.01)

(52) U.S. Cl.
CPC .. *A47B 37/00* (2013.01); *A47B 3/08* (2013.01)
USPC ..... 312/277; 108/48

(58) Field of Classification Search
CPC ..... A47B 83/00; A47B 83/045; A47B 5/00; A47B 5/04; A47B 5/02; A47B 5/06; A47B 2087/00; A47B 2095/00; A47B 2230/07; A47B 17/03; A47B 1/04; A47B 96/067; F16B 12/20
USPC ..... 312/277, 280–282, 195, 314, 312/317.1–317.3; 108/48, 134, 135, 64, 65, 108/152, 125, 126, 129–132; 403/252, 254, 403/300, 325, 329; 248/221.12, 27.3
See application file for complete search history.

(56) References Cited

U.S. PATENT DOCUMENTS

| | | | | | |
|---|---|---|---|---|---|
| 1,007,489 | A * | 10/1911 | Reichel | 108/135 |
| 1,017,239 | A * | 2/1912 | Ackerman | 312/314 |
| 1,048,596 | A * | 12/1912 | Sadej | 108/69 |
| 1,133,743 | A * | 3/1915 | Phelps | 312/235.1 |
| 1,331,635 | A * | 2/1920 | Flaherty | 108/48 |
| 1,888,127 | A * | 11/1932 | Hearne | 248/207 |
| 1,930,741 | A * | 10/1933 | Saussure, Jr. | 108/64 |
| 2,078,338 | A * | 4/1937 | Moore | 297/147 |
| 2,233,003 | A * | 2/1941 | Epps | 312/195 |
| 2,555,217 | A * | 5/1951 | Young | 269/309 |
| 2,566,256 | A | 8/1951 | Snyder | |
| 2,642,325 | A * | 6/1953 | Hinsken et al. | 108/131 |
| 2,662,720 | A * | 12/1953 | Patton | 267/141.6 |
| 3,140,135 | A * | 7/1964 | Stohlberg | 312/208.1 |
| 3,239,182 | A * | 3/1966 | Blanz | 248/682 |
| 3,336,881 | A | 8/1967 | Aiken, Sr. | |
| 3,672,312 | A | 6/1972 | Pettit et al. | |
| 3,748,010 | A * | 7/1973 | Garte | 312/314 |
| 4,409,906 | A * | 10/1983 | Alneng | 514/356 |
| 5,513,574 | A | 5/1996 | Collins | |
| 5,709,157 | A | 1/1998 | Hanusiak | |
| D487,655 | S | 3/2004 | Varsi | |
| 6,920,834 | B1 * | 7/2005 | Pehta et al. | 108/147.21 |
| 7,140,305 | B2 | 11/2006 | Christians | |
| 2002/0170471 | A1 * | 11/2002 | Laws et al. | 108/131 |
| 2005/0274302 | A1 * | 12/2005 | Jin et al. | 108/126 |

* cited by examiner

*Primary Examiner* — Janet M Wilkens

(57) ABSTRACT

A table assembly for selectively extending a countertop includes a panel that may be positioned proximate the countertop. A stand is movably coupled to and extends downwardly from the panel so the stand supports the panel. A rear leg is movably coupled to and extends downwardly from the panel so the rear leg supports the panel. A retainer is coupled to the panel. The retainer selectively engages the countertop so the panel is retained on the countertop.

19 Claims, 6 Drawing Sheets

TABLE ASSEMBLY

BACKGROUND OF THE DISCLOSURE

Field of the Disclosure

The disclosure relates to table devices and more particularly pertains to a new table device for selectively extending a countertop.

SUMMARY OF THE DISCLOSURE

An embodiment of the disclosure meets the needs presented above by generally comprising a panel that may be positioned proximate the countertop. A stand is movably coupled to and extends downwardly from the panel so the stand supports the panel. A rear leg is movably coupled to and extends downwardly from the panel so the rear leg supports the panel. A retainer is coupled to the panel. The retainer selectively engages the countertop so the panel is retained on the countertop.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
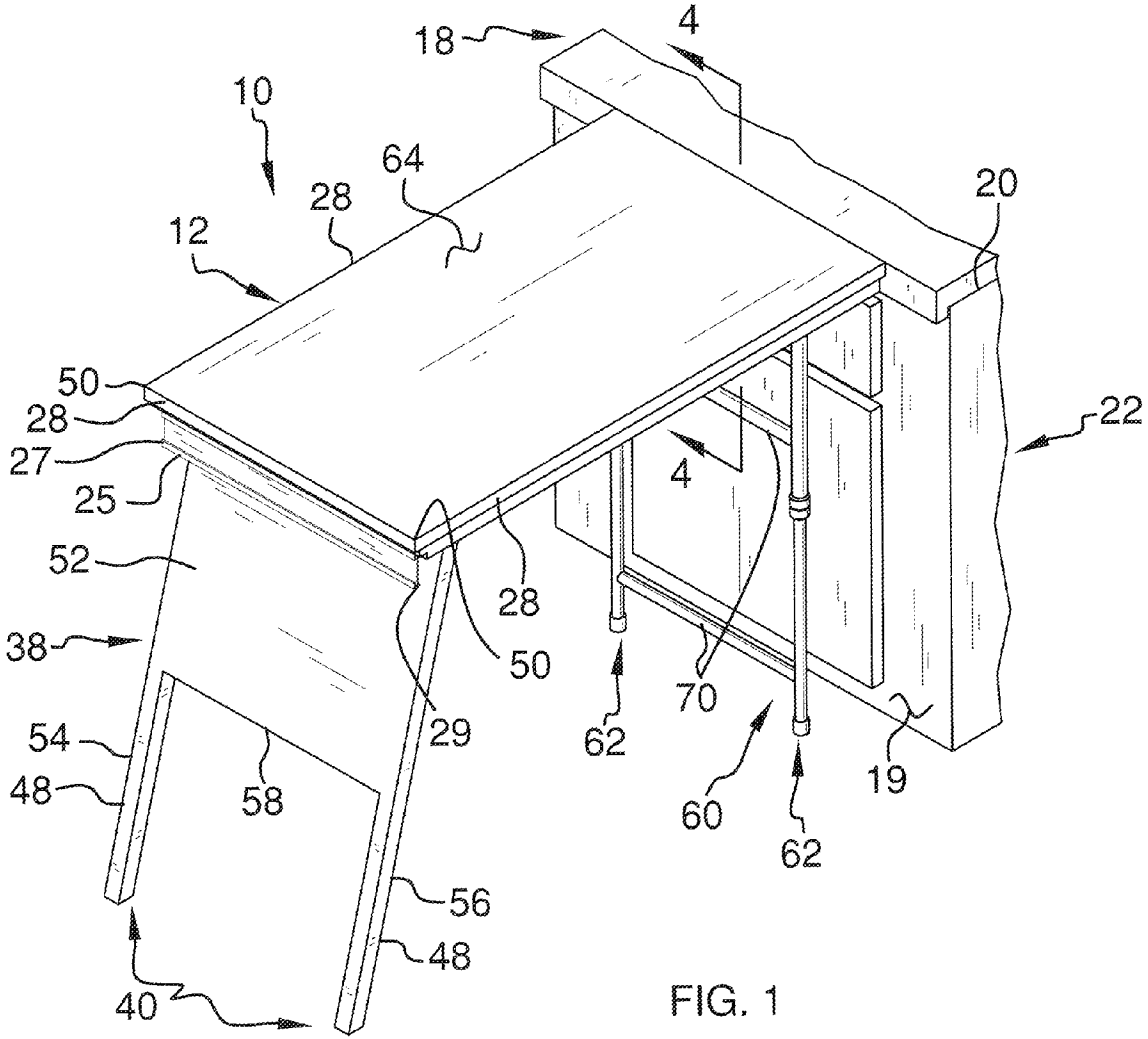
FIG. 1 is a perspective view of a table assembly according to an embodiment of the disclosure.
Figure 2:
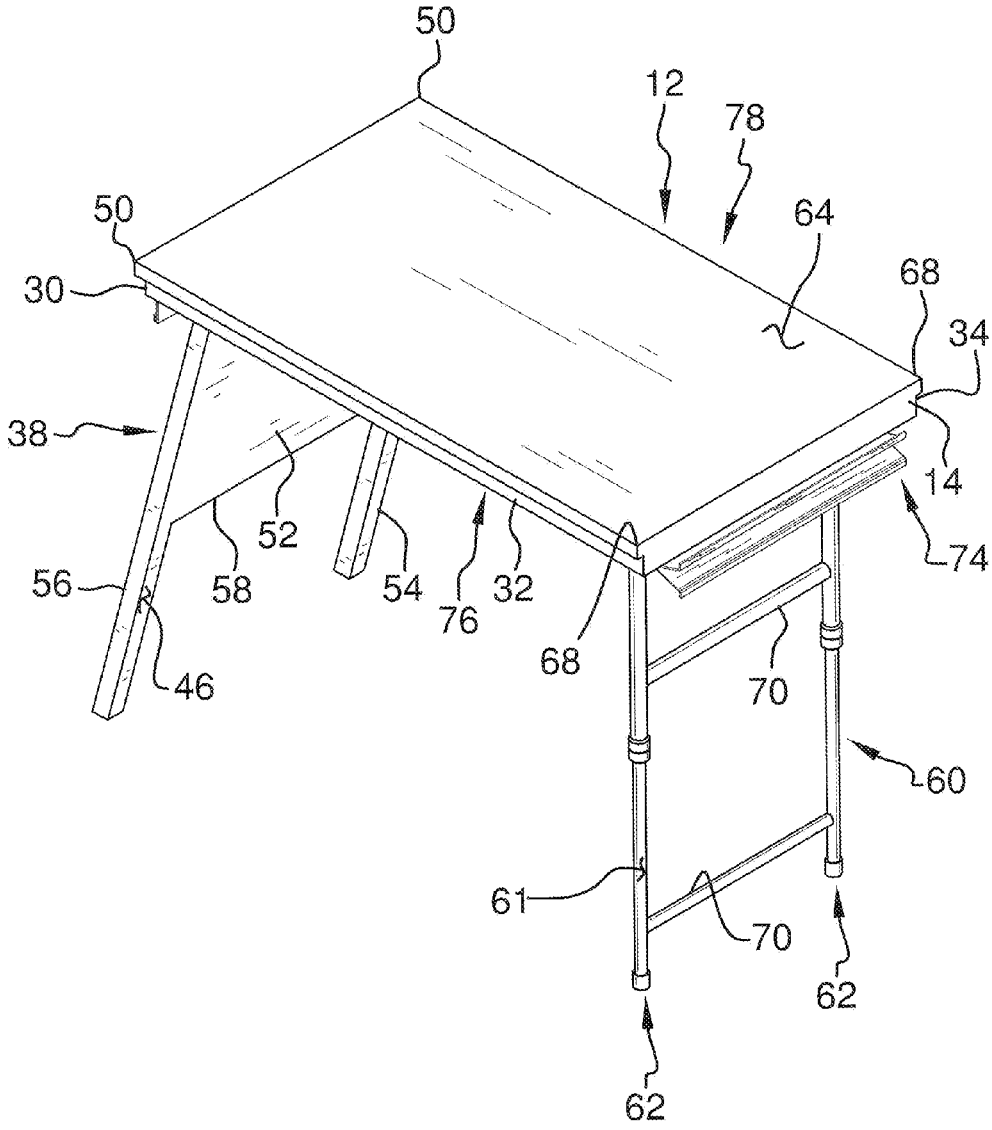
FIG. 2 is a top perspective view of an embodiment of the disclosure.
Figure 3:
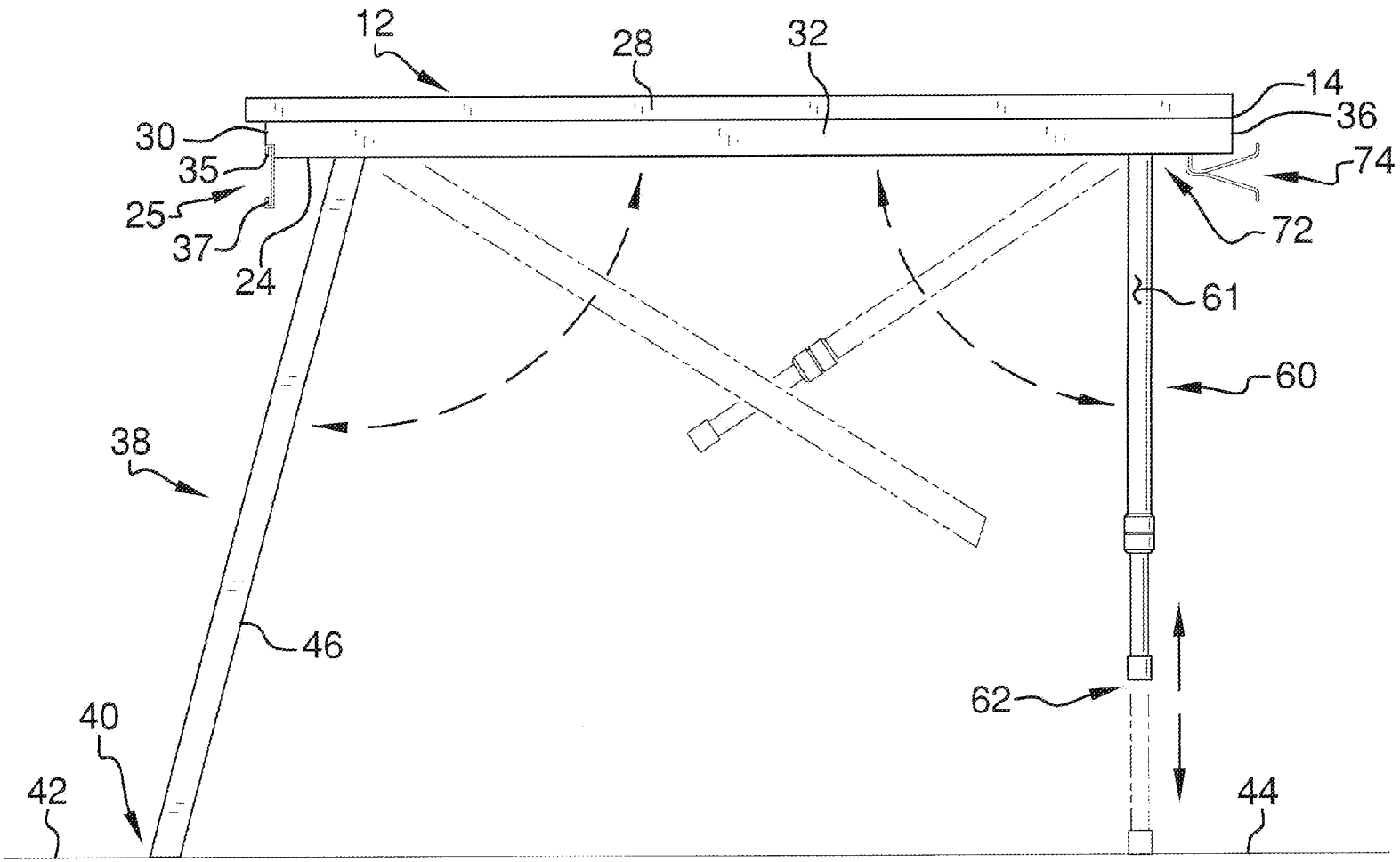
FIG. 3 is a left side view of an embodiment of the disclosure.
Figure 4:
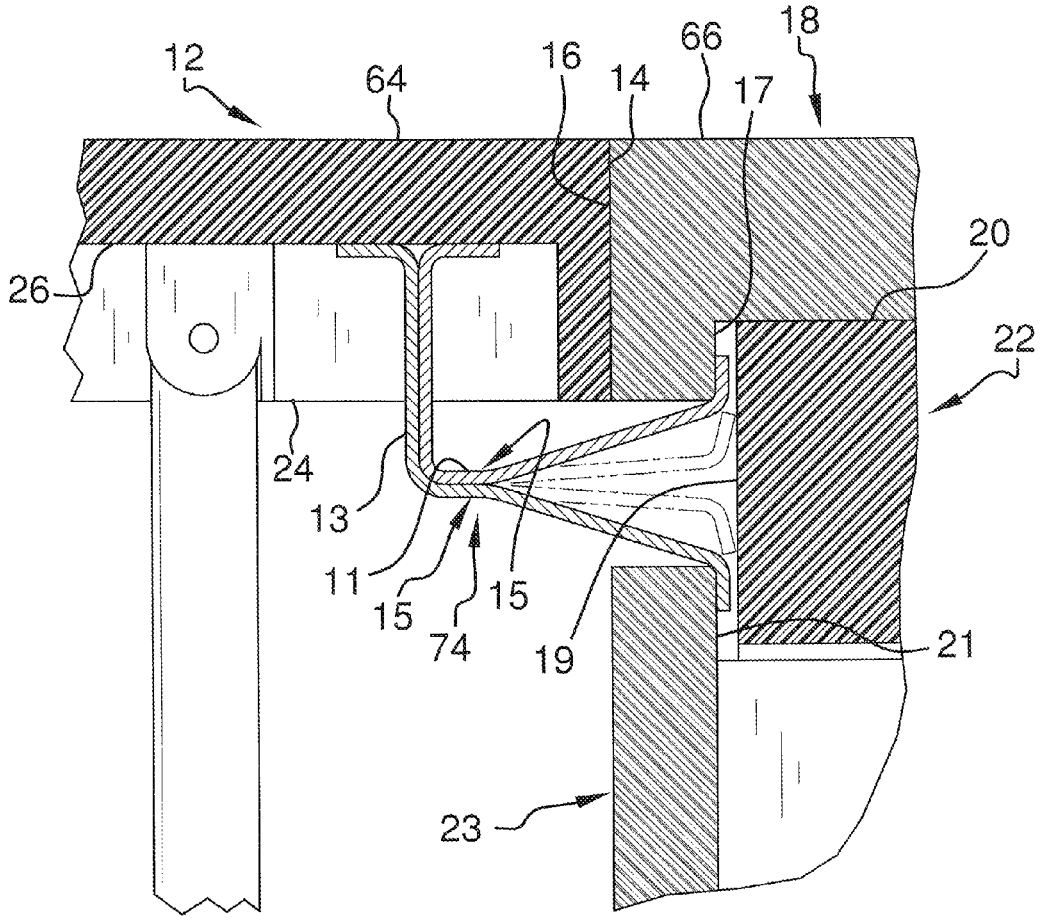
FIG. 4 is a cross sectional view taken along line 4-4 of FIG. 1 of an embodiment of the disclosure.
Figure 5:
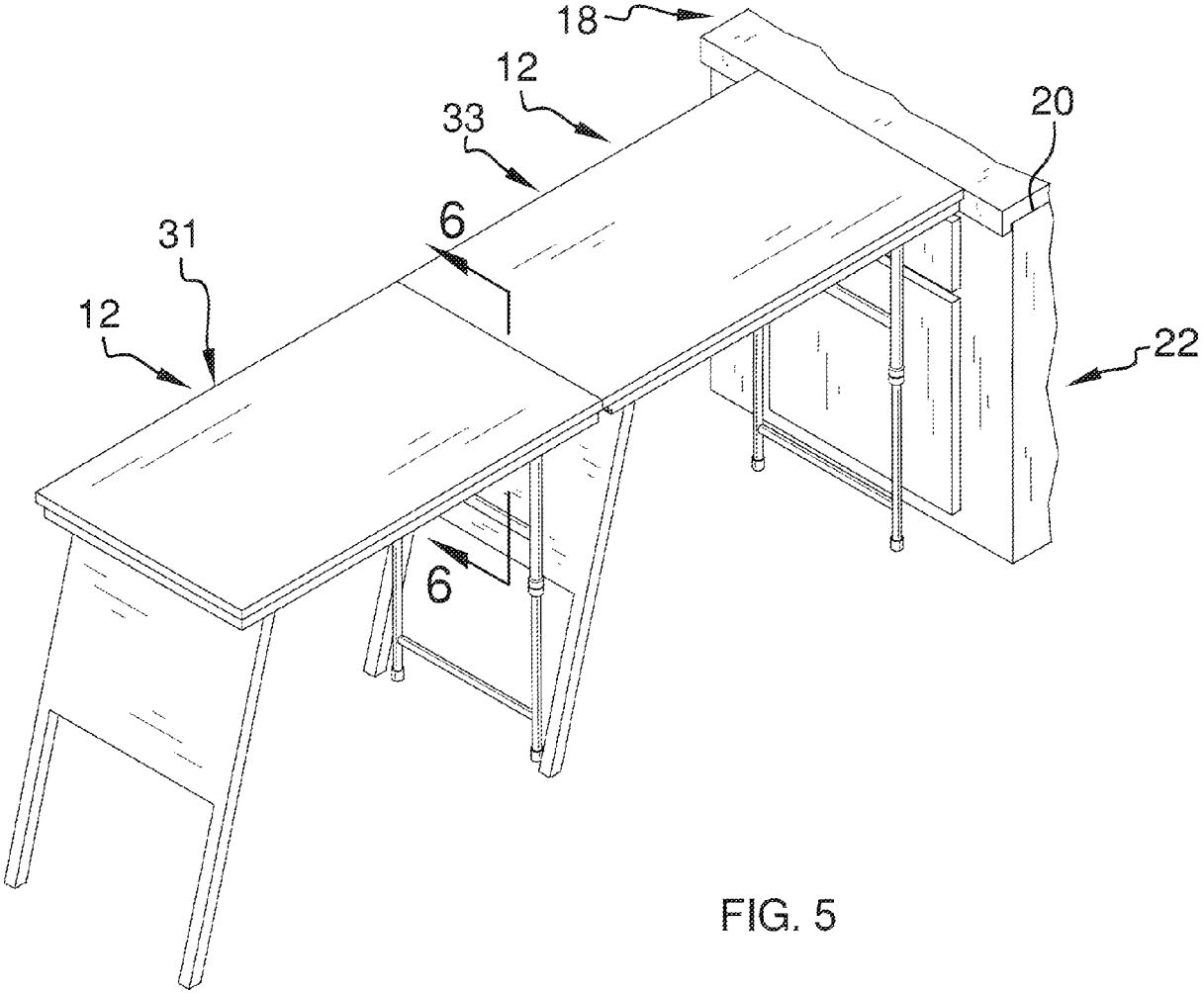
FIG. 5 is an in-use view of an embodiment of the disclosure.
Figure 6:
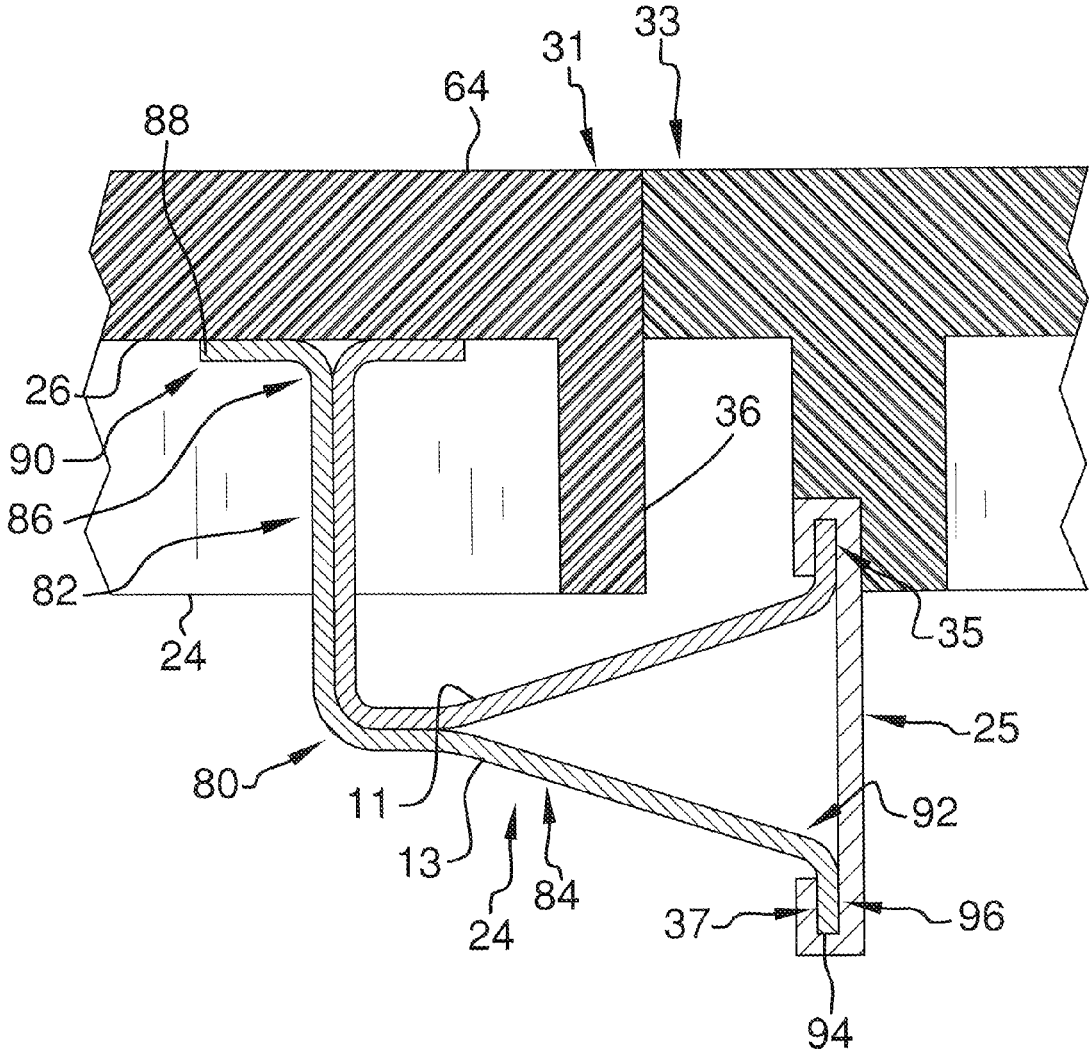
FIG. 6 is a cross sectional view taken along line 6-6 of FIG. 5 of an embodiment of the disclosure.

With reference now to the drawings, and in particular to FIGS. 1 through 6 thereof, a new table device embodying the principles and concepts of an embodiment of the disclosure and generally designated by the reference numeral 10 will be described.

As best illustrated in FIGS. 1 through 6, the table assembly 10 generally comprises a panel 12 that is positionable such that a rear edge 14 of the panel 12 abuts an exposed edge 16 of a countertop 18. The countertop 18 is coupled to a top 20 of a cabinet 22 and the panel 12 extends laterally away from the countertop 18. In addition, the panel 12 may have a length between 86 cm and 96 cm and a width between 40 cm and 50 cm. A rib 24 is coupled to and extends downwardly from a bottom 26 of the panel 12 proximate an outside edge 28 of the panel 12. Additionally, a front 30, first lateral 32 and second lateral 34 side of the rib 24 may be spaced inwardly from the associated outside edge 28 of the panel 12. A rear side 36 of the rib 24 is coextensive with the rear edge 14 of the panel 12. The rib 24 may extend downwardly from the bottom 26 of the panel 12 a distance between 2.5 cm and 5 cm.

A stand 38 is hingedly coupled to the bottom 26 of the panel 12 so the stand 38 is positionable between a deployed position and a stored position. The deployed position has the stand 38 extending downwardly from the bottom 26 of the panel 12 so a bottom end 40 of the stand 38 abuts a support surface 42. Continuing, when positioned in the deployed position the stand 38 may form an angle between 105° and 115° with respect to the bottom 26 of the panel 12. The stand 38 supports the panel 12 above the support surface 42. Additionally, the support surface 42 may be a floor 44.

The stored position has an outside surface 46 of the stand 38 abutting the bottom 26 of the panel 12. Further, the stand 38 comprises a pair of front legs 48 each positioned proximate an associated one of a pair of front corners 50 of the panel 12. A solid portion 52 of the stand 38 is coupled between a first 54 and a second 56 one of the front legs 48. Further, a bottom edge 58 of the solid portion 52 of the stand 38 is positioned proximate the bottom end 40 of the stand 38.

A rear leg 60 is hingedly coupled to the bottom 26 of the panel 12 so the rear leg 60 is positionable between a deployed position and a stored position. The deployed position has the rear leg 60 extending downwardly from the bottom 26 of the panel 12 so a bottom end 62 of the rear leg 60 abuts the support surface 42. The rear leg 60 supports the panel 12 above the support surface 42. The stored position has an outer surface 62 of the rear leg 60 abutting the bottom 26 of the panel 12.

The rear leg 60 is telescopic so the bottom end 62 of the rear leg 60 is extendable a selected distance from the bottom 26 of the panel 12. The bottom end 62 of the rear leg 60 is positioned at the selected distance so a top surface 64 of the panel 12 is co-planar with a top surface 66 of the countertop 18. In addition, the rear leg 60 is one of a pair of the rear legs 60 each positioned proximate an associated one of a pair of rear corners 68 of the panel 12. A pair of cross members 70 is coupled between each of the pair of rear legs 60. Each of the cross members 70 is positioned proximate an associated one of the bottom 62 and a top 72 ends of the pair of rear legs 60.

A retainer 74 is coupled to the bottom 26 of the panel 12 so the retainer 74 extends between a first lateral side 76 and a second lateral side 78 of the panel 12. The retainer 74 comprises a centrally positioned bend 80 so a first portion 82 of the retainer 74 forms an L-shape with respect to a second portion 84 of the retainer 74. Continuing, the retainer 74 further comprises a first bend 86 positioned proximate a first end 88 of the retainer 74 so a coupling portion 90 of the retainer 74 forms an L-shape with respect to the first portion 82 of the retainer 74. Finally, the retainer 74 further comprises a second bend 92 positioned proximate a second end 94 of the retainer 74 so an engaging portion 96 of the retainer 74 forms an L-shape with respect to the second portion 84 of the retainer 74. The coupling portion 90 of the retainer 74 is coupled to the bottom 26 of the panel 12 so the first portion 82 of the retainer 74 extends downwardly from the bottom 26 of the panel 12. The second portion 84 of the retainer 74 extends rearwardly away from the rear edge 14 of the panel 12.

The retainer 74 is one of a pair of the retainers 74 positioned such that the first portion 82 of a first one 11 of the retainers 74 coextensively abuts the first portion 82 of a second one 13 of the retainers 74. The second portion 84 of each of the first 11 and second 13 retainers has a biasing bend 15 so the engaging portion 96 of the first retainer 11 and the engaging portion 96 of the second retainer 13 are spaced apart from each other. The engaging portion 96 of the first retainer 11 is positionable between a rear surface 17 of the exposed edge 16 of the countertop 18 and a front surface 19 of the cabinet 22. The engaging portion 96 of the second retainer 13 is positionable between a rear surface 21 of a drawer 23 and the front surface 19 of the cabinet 22 so the panel 12 is removably coupled to the countertop 18. The first 11 and second 13 retainers may each be comprised of a rigid material.

A bracket 25 is coupled to the front side 30 of the rib 24 so the bracket 25 extends between the first 76 and second 78 lateral sides of the panel 12. Continuing, the bracket 25 has a C-shaped cross section taken along a longitudinal axis extending through a first 27 and a second 29 end of the bracket 25. The panel 12 may be one of a pair of panels 12. The retainer 74 on a second one 31 of the panels 12 may engage the bracket 25 on a first one 33 of the panels 12. The engaging portions 96 of the first 11 and second 13 retainers is each positionable within an associated one of a top 35 and bottom 37 retainer space in the bracket 25 so the second panel 31 is removably coupled to the first panel 33.

In use, the first panel 33 may be coupled to the countertop 18 to temporarily extend the countertop 18. The second portion 84 of each of the first 11 and second 13 retainers may be urged toward each other so the engaging portions 96 of each of the first 11 and second 13 retainers may be positioned proximate the front surface 19 of the cabinet 22. Continuing, the second portion 84 of each of the first 11 and second 13 retainers may be released so the engaging portions 96 of each of the first 11 and second 13 retainers engages the associated one of the countertop 22 and the drawer 23. The second panel 31 is coupled to the first panel 33 to temporarily increase a useable area of the countertop 18.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A table assembly for selectively extending a countertop, said assembly comprising:

a countertop;

a panel positioned proximate the countertop;

a stand movably coupled to and extending downwardly from said panel wherein said stand supports said panel;

a rear leg movably coupled to and extending downwardly from said panel wherein said rear leg supports said panel;

a retainer coupled to said panel, said retainer selectively engaging the countertop wherein said panel is retained on the countertop;

a coupling portion of said retainer being coupled to a bottom of said panel wherein a first portion of said retainer extends downwardly from said bottom of said panel wherein a second portion of said retainer extends rearwardly away from a rear edge of said panel;

said retainer being one of a pair of said retainers positioned such that a first portion of a first one of said pair of retainers coextensively abuts a first portion of a second one of said pair of retainers wherein an engaging portion of said first retainer is spaced apart from an engaging portion of said second retainer; and said engaging portion of said first retainer being positionable between a rear surface of an exposed edge of the countertop and a front surface of a cabinet, said engaging portion of said second retainer being positionable between a rear surface of a drawer and the front surface of the cabinet wherein said panel is removably coupled to the countertop.

2. The assembly according to claim 1, further comprising said panel being positionable such that a rear edge of said panel abuts an exposed edge of the countertop wherein said panel extends laterally away from the countertop.

3. The assembly according to claim 1, further comprising said stand being hingedly coupled to a bottom of said panel wherein said stand is positionable between a deployed and a stored position.

4. The assembly according to claim 3, further comprising said stand being positionable in said deployed position having said stand extending downwardly from said bottom of said panel wherein a bottom end of said stand abuts a support surface.

5. The assembly according to claim 3, further comprising said stand being positionable in said stored position wherein an outside surface of said stand abuts said bottom of said panel.

6. The assembly according to claim 1, further comprising said stand comprising a pair of front legs each positioned proximate an associated one of a pair of front corners of said panel.

7. The assembly according to claim 1, further comprising said rear leg being hingedly coupled to a bottom of said panel wherein said rear leg is positionable between a deployed position and a stored position.

8. The assembly according to claim 7, further comprising said rear leg being positionable in said deployed position having said rear leg extending downwardly from said bottom of said panel wherein a bottom end of said rear leg abuts a support surface.

9. The assembly according to claim 7, further comprising said rear leg being positionable in said stored position wherein an outer surface of said rear leg abuts said bottom of said panel.

10. The assembly according to claim 1, further comprising said rear leg being telescopic wherein a bottom end of said rear leg is extendable a selected distance from a bottom of said panel.

11. The assembly according to claim 1, further comprising said rear leg being one of a pair of said rear legs each positioned proximate an associated one of a pair of rear corners of said panel.

12. The assembly according to claim 1, further comprising:

said retainer further comprising a centrally positioned bend wherein said first portion of said retainer forms an L-shape with respect to said second portion of said retainer;

said retainer further comprising a first bend positioned proximate a first end of said retainer wherein a coupling portion of said retainer forms an L-shape with said first portion of said retainer; and said retainer further comprising a second bend positioned proximate a second end of said retainer wherein an engaging portion of said retainer forms an L-shape with respect to said second portion of said retainer.

13. The assembly according to claim 1, further comprising a bracket coupled to a front of said panel wherein said bracket extends between a first lateral side and a second lateral side of said panel.

14. A table assembly for selectively extending a countertop, said assembly comprising:

a countertop;

a panel being positionable such that a rear edge of said panel abuts an exposed edge of the countertop wherein said panel extends laterally away from the countertop;

a stand hingedly coupled to a bottom of said panel wherein said stand is positionable between a deployed having said stand extending downwardly from said bottom of said panel wherein a bottom end of said stand abuts a support surface wherein said stand supports said panel above the support surface and a stored position wherein an outside surface of said stand abuts said bottom of said panel, said stand comprising a pair of front legs each positioned proximate an associated one of a pair of front corners of said panel;

a rear leg hingedly coupled to a bottom of said panel wherein said rear leg is positionable between a deployed position having said rear leg extending downwardly from said bottom of said panel wherein a bottom end of said rear leg abuts the support surface wherein said rear leg supports said panel above the support surface and a stored position wherein an outer surface of said rear leg abuts said bottom of said panel, said rear leg being telescopic wherein said bottom end of said rear leg is extendable a selected distance from said bottom of said panel, said rear leg being one of a pair of said rear legs each positioned proximate an associated one of a pair of rear corners of said panel;

a retainer coupled to said panel, said retainer comprising a centrally positioned bend wherein a first portion of said retainer forms an L-shape with respect to a second portion of said retainer, said retainer further comprising a first bend positioned proximate a first end of said retainer wherein a coupling portion of said retainer forms an L-shape with said first portion of said retainer, said retainer further comprising a second bend positioned proximate a second end of said retainer wherein an engaging portion of said retainer forms an L-shape with respect to said second portion of said retainer, said coupling portion of said retainer being coupled to said bottom of said panel wherein said first portion of said retainer extends downwardly from said bottom of said panel wherein said second portion of said retainer extends rearwardly away from said rear edge of said panel, said retainer being one of a pair of said retainers positioned such that said first portion of a first one of said pair of retainers coextensively abuts said first portion of a second one of said pair of retainers wherein said engaging portion of said first retainer is spaced apart from said engaging portion of said second retainer, said engaging portion of said first retainer being positionable between a rear surface of the exposed edge of the countertop and a front surface of a cabinet, said engaging portion of said second retainer being positionable between a rear surface of a drawer and the front surface of the cabinet wherein said panel is removably coupled to the countertop; and a bracket coupled to a front of said panel wherein said bracket extends between a first lateral side and a second lateral side of said panel.

15. A table assembly for selectively extending a countertop, said assembly comprising:

a countertop;

a panel positioned proximate the countertop;

a stand movably coupled to and extending downwardly from said panel wherein said stand supports said panel;

a rear leg movably coupled to and extending downwardly from said panel wherein said rear leg supports said panel;

a retainer coupled to said panel, said retainer selectively engaging said countertop wherein said panel is retained on the countertop;

said retainer further comprising a centrally positioned bend wherein a first portion of said retainer forms an L-shape with respect to a second portion of said retainer;

said retainer further comprising a first bend positioned proximate a first end of said retainer wherein a coupling portion of said retainer forms an L-shape with said first portion of said retainer; and said retainer further comprising a second bend positioned proximate a second end of said retainer wherein an engaging portion of said retainer forms an L-shape with respect to said second portion of said retainer.

16. The assembly according to claim 15, further comprising said stand being hingedly coupled to a bottom of said panel wherein said stand is positionable between a deployed and a stored position.

17. The assembly according to claim 16, further comprising said rear leg being hingedly coupled to a bottom of said panel wherein said rear leg is positionable between a deployed position and a stored position.

18. The assembly according to claim 17, further comprising said rear leg being telescopic wherein a bottom end of said rear leg is extendable a selected distance from a bottom of said panel.

19. The assembly according to claim 15, further comprising a bracket coupled to a front of said panel wherein said bracket extends between a first lateral side and a second lateral side of said panel.

* * * * *